US006938529B2

(12) United States Patent
Klas

(10) Patent No.: US 6,938,529 B2
(45) Date of Patent: Sep. 6, 2005

(54) SHORTENING THE FLAP OF PAPER FOLLOWING A SUPPLY-ROLL CHANGE

(75) Inventor: Ernst Klas, Siegburg (DE)

(73) Assignee: Goss Contiweb, B.V., Boxmeer (NL)

( * ) Notice: Subject to any disclaimer, the term of this patent is extended or adjusted under 35 U.S.C. 154(b) by 141 days.

(21) Appl. No.: 10/362,804

(22) PCT Filed: Jul. 24, 2001

(86) PCT No.: PCT/EP01/08530

§ 371 (c)(1),
(2), (4) Date: Apr. 1, 2003

(87) PCT Pub. No.: WO02/16241

PCT Pub. Date: Feb. 28, 2002

(65) Prior Publication Data

US 2003/0164076 A1 Sep. 4, 2003

(30) Foreign Application Priority Data

Aug. 25, 2000 (DE) ..... 100 41 969

(51) Int. Cl.[7] ..... B65H 19/20; B65H 21/00

(52) U.S. Cl. ..... 83/13; 83/22; 83/23; 83/24; 83/100; 83/102; 83/105; 83/152; 83/949; 83/856; 83/650; 242/554.2; 156/159; 493/346

(58) Field of Search ..... 83/13, 20, 22, 83/24, 98, 99, 100, 102, 105, 152, 169, 856, 949, 650; 242/554.2; 156/157, 159, 267, 269, 270, 504; 493/346

(56) References Cited

U.S. PATENT DOCUMENTS 4,097,323 A * 6/1978 De Roeck et al. ..... 156/159
4,315,794 A * 2/1982 Palmieri ..... 156/504
5,064,488 A * 11/1991 Dickey ..... 156/159
5,101,701 A * 4/1992 Boldrini et al. ..... 83/13
5,356,496 A * 10/1994 Lincoln et al. ..... 156/64
5,411,223 A * 5/1995 Gatteschi ..... 242/551
5,474,252 A * 12/1995 Schmid ..... 242/554.2
5,699,978 A * 12/1997 Hanazawa ..... 242/552
5,740,982 A * 4/1998 Kaufmann ..... 242/555.3
5,827,166 A * 10/1998 Cestonaro et al. ..... 493/344
6,547,179 B1 * 4/2003 Klas ..... 242/555.3
6,726,614 B1 * 4/2004 Klas ..... 493/342

FOREIGN PATENT DOCUMENTS

DE 198 04 415 8/1999
DE 199 31 797 12/2000

* cited by examiner

*Primary Examiner*—Boyer D. Ashley
(74) *Attorney, Agent, or Firm*—Herbert Dubno; Andrew Wilford

(57) ABSTRACT

A flap projecting from a glue joint between two paper strips after an on-the-fly supply roll change is shortened by continuously displacing the strips in a straight line, in a travel direction, and at a travel speed along a path such that the flap lies flatly against an outer face of the strips and engaging at least a part of a separating device against the outer face in the path. At least the part of the separating device engaging the strip is displaced in the travel direction at a speed greater than the travel speed such that, when the separating device engages the flap, the flap is bowed out away from the outer face downstream of the separating device. A blade is juxtaposed with the outer face of the strip immediately downstream of the separating device such that the bowed out flap engages and is cut by the blade.

15 Claims, 2 Drawing Sheets

SHORTENING THE FLAP OF PAPER FOLLOWING A SUPPLY-ROLL CHANGE

CROSS REFERENCE TO RELATED APPLICATIONS

This application is the US national phase of PCT application PCT/EP01/08530, filed 24 Jul. 2001, published 28 Feb. 2002 as WO 02/16241, and claiming the priority of German patent application 10041969.0 itself filed 25 Aug. 2000.

FIELD OF THE INVENTION

The invention relates to a method of shortening a flap hanging off a continuously moving paper strip, in particular the flap left after an on-the-fly roll change downstream of a location where two paper strips are glued together wherein the paper strip is moved past a separating device moving faster than the paper strip and the flap is frictionally engaged by the separating device and separated from the paper strip and severed neared the joined location. The invention further relates to an apparatus intended for carrying out this method according to the invention.

BACKGROUND OF THE INVENTION

Continuously operating paper-treating machines, in particular rotating-roll machines, are loaded with paper strips that are wound off supply rolls. When one roll is depleted, it is replaced by a new roll without stopping the treatment machine. Roll changers are known that effect a so-called "on-the-fly roll change." This is done by providing an adhesive band on the leading end of a fresh roll waiting for use. The new roll is rotated and brought to a peripheral speed that is synchronized with that of the almost empty roll. At the appropriate time the paper strip is pressed against the new roll so as to contact the adhesive band. In this manner the leading end of the new strip is adhered to the running-out strip. The running-out strip is cut off after a slight delay. The delay is necessitated by the inertia of the cutter and the cycling time of the control system. This leaves a so-called flap that projects from the adhesive band and that has a length determined by the length of the delay. The length of the flap is a function of the strip speed as well as of the delay time. If for example the delay is 10 ms and the strip speed is 15 m/s, the flap is 150 mm long.

Practice has shown that such flaps can cause problems in the downstream treatment stations. German patent document 198 04 415, which the instant invention is based on, describes a method that manages to cut the flap to a harmless residue of at most several millimeters long. It also describes several systems for carrying out the method with this known method the glued-together paper strips are deflected about an arc having a center of curvature on the face opposite the flap. When the flap moves through the arc it is swung out by centrifugal force and cut by a blade that is closely spaced from the strip. The separating effect of the centrifugal force can be augmented by an air blast that is directed between the paper strip and the flap parallel to the travel direction of the strip. In order to ensure that the cut is made, in one embodiment a separating device, e.g. a suction drum or belt, is set at a spacing of 20 to 60 mm from the paper strip upstream of the blade and is driven at a speed that is greater than the travel speed of the strip. The flap that is separated by the air blast and centrifugal force from the strip is held by the suction of the separating device, accelerated by friction, and thus fed to the blade.

OBJECT OF THE INVENTION

It is an object of the invention to simplify the method described above and also to provide a simplified apparatus for carrying out the new method.

SUMMARY OF THE INVENTION

The first part of the stated object is attained in that the flap is engaged by the separating device while it is still lying against the paper strip. Unlike the prior art, with the new method the flap is not first separated from the strip before it is frictionally engaged by the separating device. The separating device engages the flap while it is lying against the strip and accelerates it to a speed greater than the travel speed of the strip. This bows out the flap right up to the location where it is glued to the strip and in this manner separates it from the strip. The flap moves to the blade in this position and is cut immediately adjacent the glued location.

The second part of the stated object is attained in that during an on-the-fly supply-roll change the envelope engages the paper strip.

BRIEF DESCRIPTION OF THE DRAWING

The drawing serves for explaining the invention.

SPECIFIC DESCRIPTION

Figure 1:
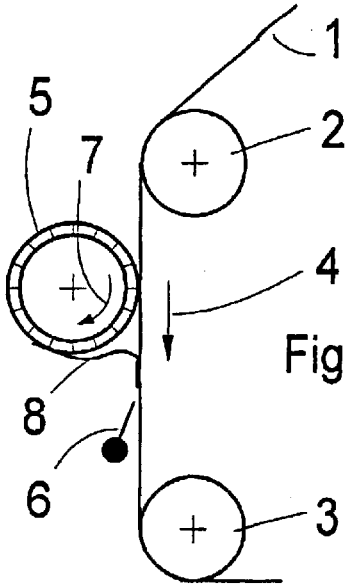
FIGS. 1 through 7 schematically show respective embodiments of the invention.

As shown in FIG. 1, a paper strip 1 is guided over two vertically spaced deflecting rolls 2 and 3. Between the two deflecting rolls 2 and 3 the strip 1 moves in the direction of arrow 4 in a straight path. Closely juxtaposed with the strip path is a rotatably mounted suction drum 5 that engages the paper strip 1 in a line or narrow band. The interior of the suction drum 5 is connected to the intake of an unillustrated blower. The perforated surface of the suction drum 5 has relative to paper a higher coefficient of friction than paper does on paper. In order to achieve this, it is rubber coated. The suction drum 5 is connected with an unillustrated rotary drive. Closely juxtaposed below the suction drum is a blade 6. Its cutting edge, which is preferably serrated, is directed toward the suction drum 5, that is against the travel direction 4 of the paper strip 1. The spacing between the paper strip 1 and the blade 6 determines the length of the residue of a flap 8 projecting from a glue joint between two paper bands forming the strip 1; it thus is preferably at most a few millimeters.

In practice when the drive is shut off the suction drum 5 is moved into an unillustrated rest position out of contact with the paper strip 1. Shortly before a supply-roll change, the suction drum 5 is moved into the position of FIG. 1.

Simultaneously the blower is turned on. The drive is also turned on so that the suction drum 5 is rotated in the direction of arrow 7. The rotation rate is so high that its peripheral speed is substantially greater than the travel speed of the paper strip. The speeds lie at a ratio of between 1/1.5 and 1/10. Thus as soon as the glued location passes the contact line between the suction drum 5 and the paper strip 1, the flap 8, which to start with is pressed by the surrounding air flatly against the paper strip 1, is engaged frictionally by the suction drum 5. The outer surface of the suction drum 5 is in this case an envelope that is frictionally effective. The flap 8 is moved downstream with the peripheral velocity of the suction drum 5 so that its face turned toward the paper strip starts to slide. This bows out the downstream portion of the flap 8. The bowed-out flap 8 separated from the paper strip 1 engages the blade 6 and is thus cut off, leaving a harmless residue. Then the suction drum 5 is moved back into its rest position. This process is repeated each time a supply roll is changed, that is every 20 to 30 minutes.

Figure 2:
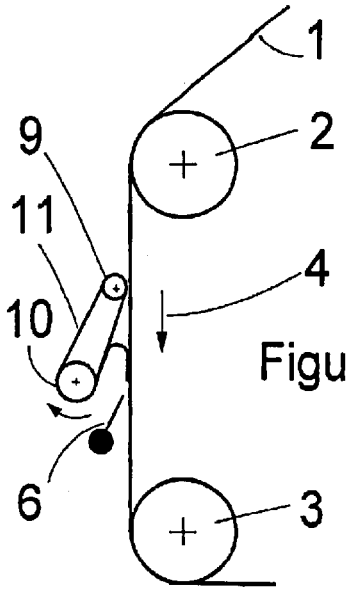

The apparatus shown in FIG. 2 is different from that described above in that instead of the suction drum 5 there is an endless suction belt 11 spanned over rolls 9 and 10. Between the active reach closer to the paper strip and the other reach there is an unillustrated suction box that is open on its side toward the active reach. The suction box is connected with an unillustrated blower. When in use, the upper upstream roll 9 is so closely juxtaposed with the paper strip 1 that the suction belt 11 whose outer face is the envelope bears lightly on the paper strip 1. The spacing between the other roll 10 and the paper strip 1 is greater so that the spacing between the suction belt 11 and the paper strip 1 increases in the travel direction 4. Operation is like the operation described with reference to FIG. 1 so that further discussion is unnecessary.

Figure 3:
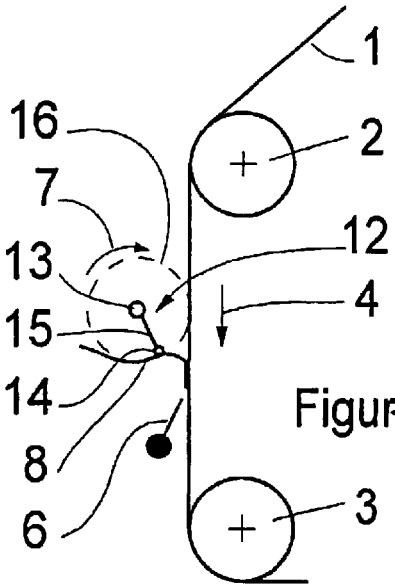

FIG. 3 shows a further embodiment wherein the entrainment element is a rotor 12 that is connected with an unillustrated rotary drive. The rotor 12 is formed mainly as a shaft 13 and a round rod 14 parallel to it and fixed to the shaft 13 by radial arms 15. The rod 14 is provided with a friction-increasing covering. The spacing between the axis of the shaft 13 when in use and the paper strip 1 is a little smaller than the radius of the envelope 16 which is defined by the orbit of the rotor 12. In other words, the rod 14 orbiting in the direction of the arrow 7 about the shaft 13 engages lightly on the passing paper strip 1.

It is clear that the rotor 12 can have a plurality of the rods 14 which are arranged like a star, angularly equispaced about the shaft 12.

In practice the flap 8 which moves past the rotor 12 is struck at least once by the rod 14. Preferably the lengths of the arms 15, the rotation rate of the rotor 12, and the number of rods 14 of the rotor 12 are such that each passing flap 8 is struck several times. With each blow the part of the flap 8 that is struck is frictionally engaged by the rod 14 that is moving faster than the paper strip 1 and is pushed relative to the paper strip 1 in the travel direction 4. Thus the leading part of the flap 8 is bowed out and separated from the paper strip 1. The flap 8 arrives at the blade 6 in this position and is cut off, leaving a harmless residue.

Figure 4:
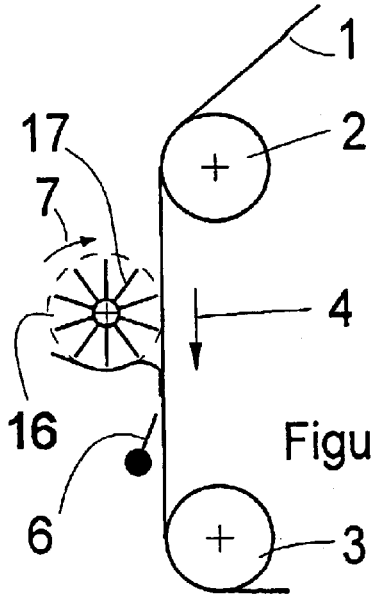

In the embodiment of FIG. 4 the separating element is a round brush 17 rotatable about its axis. The distance between the axis of the brush 17 and the paper strip 1 is a little smaller than the radius of the envelope 16. When the brush 17 is in its use position and rotates in the direction 7, the paper strip 1 is stroked in a narrow band by the brush 17. When a flap 8 comes into the band-shaped effective range of the brush 17, it is moved by friction relative to the paper strip 1 in the travel direction 4 so that the leading part of the flap 8, which has already passed the effective range, bows out.

Figure 5:
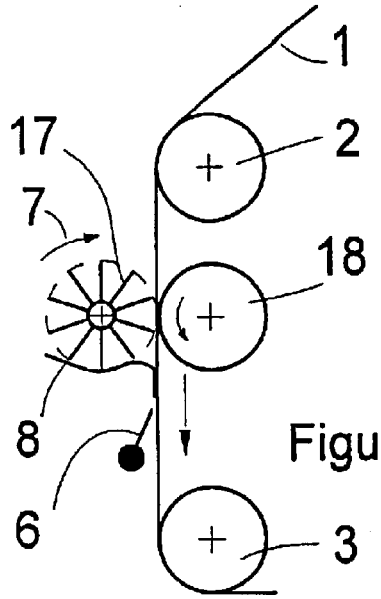
Figure 6:
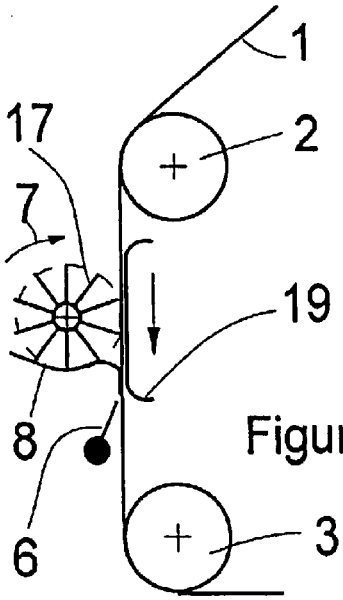
Figure 7:
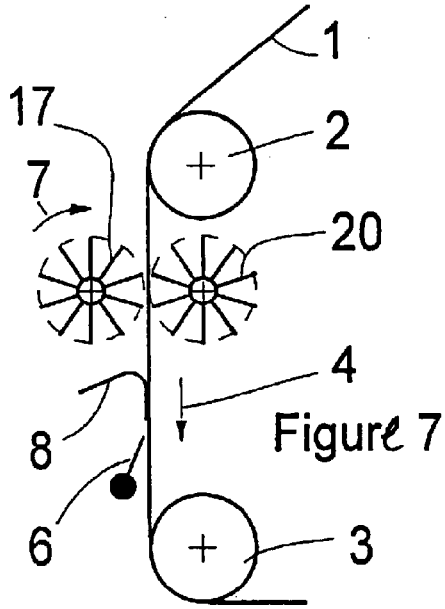

In the embodiments shown in FIGS. 5 through 7, the separating element is the round brush 17. An inner side of the passing paper strip 1 engages opposite the brush 17 against a support, in FIG. a support roll 18, in FIG. 6 a slide plate 19, and in FIG. 7 a round brush 20. The provision of a support element is particularly advantageous when the separating element is a round brush 17. The support 18, 19, or 20 bears with a countervailing force which is necessary to create sufficient friction. In the embodiment according to FIG. 7 the separating effect is increased by the repulsive effect of an electrical charge that is created by contact with the brushes 17 and 20 as well as with the flap 8 and paper strip 1.

I claim:

1. A method of shortening a flap projecting from a glue location between two paper strips after an on-the-fly supply roll change, the method comprising the steps of:

continuously displacing the strips in a straight line, in a travel direction, and at a travel speed along a path such that the flap lies flatly against an outer face of the strips;

engaging at least a part of a separating device against the outer face in the path;

displacing at least the part of the separating device in the travel direction at a speed greater than the travel speed such that, when the separating device engages the flap, the flap is bowed out away from the outer face downstream of the separating devices; and juxtaposing a blade with the outer face of the strip immediately downstream of the separating device such that the bowed out flap engages and is cut by the blade.

2. The flap-shortening method defined in claim 1 wherein the separating device is a roll having a surface forming the part, the roll being rotated to displace the part.

3. The flap-shortening method defined in claim 1 wherein the separating device is a rod having a surface forming the part, the rod being orbited about an axis adjacent the path to displace the part.

4. The flap-shortening method defined in claim 1 wherein the separating device is a round brush having bristles whose outer ends form the part, the brush being rotated about an axis adjacent the path to displace the part.

5. The flap-shortening method defined in claim 1 wherein the separating device is a suction belt having a stretch with an outer surface forming the part, the stretch being advanced in the travel direction to displace the part.

6. The flap-shortening method defined in claim 1, further comprising the step of supporting an inner face of the strips in the path opposite the outer face and thereby preventing transverse deflection of the strips by the device away from the device.

7. The flap-shortening method defined in claim 1, further comprising the step of electrostatically charging the strips and flap in the path and thereby urging the flap to separate from the strips in the path.

8. The flap-shortening apparatus defined in claim 1 wherein the separating device is a suction belt having a stretch with an outer surface forming the part, the drive means advancing the stretch in the travel direction to displace the part.

9. An apparatus for shortening a flap projecting from a glue location between two paper strips after an on-the-fly supply roll change, the apparatus comprising:

conveyor means for continuously displacing the strips in a straight line, in a travel direction, and at a travel speed along a path such that the flap lies flatly against an outer face of the strips.

a separating device juxtaposed with the path and having a part engaging the outer face in the path;

drive means for displacing at least the part of the separating device in the travel direction at a speed greater than the travel speed such that, when the separating device engages the flap, the flap is bowed out away from the outer face downstream of the separating device; and a blade a blade juxtaposed with the outer face of the strip immediately downstream of the separating device, whereby the bowed out flap engages and is cut by the blade.

10. The flap-shortening apparatus defined in claim 9, wherein the separating device is a roll having a surface forming the part, the drive means rotating the roll being to displace the part.

11. The flap-shortening apparatus defined in claim 9 wherein the separating device is a rod having a surface forming the part, the drive means orbiting the rod being about an axis adjacent the path to displace the part.

12. The flap-shortening apparatus defined in claim 9 wherein the separating device is a round brush having bristles whose outer ends form the part, the drive means rotating the brush about an axis adjacent the path to displace the part.

13. The flap-shortening apparatus defined in claim 9, further comprising a support engaging an inner face of the strips in the path opposite the outer face and preventing transverse deflection of the strips by the device away from the device.

14. The flap-shortening apparatus defined in claim 13 wherein the support is a rotating brush engaging the inner face.

15. The flap-shortening apparatus defined in claim 13 wherein the support is a plate engaging the inner face.

* * * * *